US010420174B2

(12) United States Patent
Kimmins et al.

(10) Patent No.: US 10,420,174 B2
(45) Date of Patent: Sep. 17, 2019

(54) LOW-VOLTAGE FLUID HEATER

(75) Inventors: Russell Wayne Kimmins, Upper Mount Gravatt (AU); Peter Damien Hurley, Cleveland (AU)

(73) Assignee: Cosmos Solar Pty Ltd, Capalaba, QLD (AU)

( * ) Notice: Subject to any disclaimer, the term of this patent is extended or adjusted under 35 U.S.C. 154(b) by 583 days.

(21) Appl. No.: 13/320,271

(22) PCT Filed: May 13, 2010

(86) PCT No.: PCT/AU2010/000562

§ 371 (c)(1),
(2), (4) Date: Nov. 13, 2011

(87) PCT Pub. No.: WO2010/130004

PCT Pub. Date: Nov. 18, 2010

(65) Prior Publication Data

US 2012/0055917 A1 Mar. 8, 2012

Related U.S. Application Data

(60) Provisional application No. 61/265,584, filed on Dec. 1, 2009.

(30) Foreign Application Priority Data

May 14, 2009 (AU) ..... 2009902161
Feb. 24, 2010 (AU) ..... 2010900772

(51) Int. Cl.
*H05B 3/02* (2006.01)
*H05B 3/10* (2006.01)
(Continued)

(52) U.S. Cl.
CPC ..... *H05B 3/82* (2013.01); *F24H 1/202* (2013.01); *H05B 3/42* (2013.01); *H05B 3/78* (2013.01); *H05B 2203/021* (2013.01)

(58) Field of Classification Search
CPC ..... F24H 1/202; H05B 3/42; H05B 3/82
(Continued)

(56) References Cited

U.S. PATENT DOCUMENTS 2,816,200 A 12/1957 Mudge
3,441,712 A * 4/1969 Hynes ..... 219/539
(Continued)

FOREIGN PATENT DOCUMENTS

CN 2567504 Y 8/2003
CN 2901163 Y 5/2007
(Continued)

OTHER PUBLICATIONS

Machine translation of CN2935011 to Chen, Yajing dated Aug. 15, 2007.*
(Continued)

*Primary Examiner* — Joseph M Phelham
(74) *Attorney, Agent, or Firm* — Patterson + Sheridan, LLP

(57) ABSTRACT

Techniques for heating fluids with uninsulated heating elements. The techniques generally include supplying a source of high voltage of at least 100V, transforming the voltage to low voltage and heating an uninsulated element with said low voltage thereby heating the fluid.

14 Claims, 2 Drawing Sheets

(51) Int. Cl.

| | |
|---|---|
| ***H05B 3/78*** | (2006.01) |
| ***H05B 3/82*** | (2006.01) |
| ***F24H 1/20*** | (2006.01) |
| ***H05B 3/42*** | (2006.01) |

(58) Field of Classification Search
USPC ..... 219/488, 489; 392/441, 451
See application file for complete search history.

(56) References Cited

U.S. PATENT DOCUMENTS

| | | | | |
|---|---|---|---|---|
| 3,691,441 | A * | 9/1972 | Hasselbach | H02K 23/64 318/441 |
| 3,760,147 | A | 9/1973 | Tyrey | |
| 4,424,438 | A * | 1/1984 | Antelman et al. | 219/491 |
| 4,581,522 | A * | 4/1986 | Graham | F24D 19/1096 219/213 |
| 4,871,308 | A | 10/1989 | Norton et al. | |
| 5,039,840 | A | 8/1991 | Boardman | |
| 5,237,140 | A * | 8/1993 | Akazawa | H01F 38/08 219/716 |
| 5,380,987 | A | 1/1995 | Morici | |
| 6,303,908 | B1 * | 10/2001 | Yamaga | F27D 11/02 118/724 |
| 6,369,366 | B1 * | 4/2002 | Mullen | A21B 1/52 219/450.1 |
| 7,081,602 | B1 * | 7/2006 | Black | H05B 3/46 219/522 |
| 7,209,651 | B1 | 4/2007 | Knoeppel et al. | |
| 2003/0000940 | A1 | 1/2003 | Furlong et al. | |
| 2006/0076835 | A1 * | 4/2006 | Slocum | B63J 3/04 307/29 |
| 2008/0149614 | A1 * | 6/2008 | Jenkins | A45C 15/00 219/386 |

FOREIGN PATENT DOCUMENTS

| | | | |
|---|---|---|---|
| CN | 2935011 | Y | 8/2007 |
| KR | 20040080692 | A | 9/2004 |

OTHER PUBLICATIONS

Summary of First Chinese Office Action dated Feb. 8, 2013, for corresponding Chinese Patent Application No. 201080022009.2 prepared by Mr. Bill H. Zhang.
First Office Action dated Feb. 8, 2013, for corresponding Chinese Patent Application No. 201080022009.2.
International Preliminary Report on Patentability, dated Sep. 13, 2011.
Written Opinion of the International Searching Authority, dated Jun. 11, 2010.
International Search Report, dated Jun. 16, 2010.
Office Action from Chinese Patent Application No. 201410123842.6 dated Sep. 13, 2016.

* cited by examiner

LOW-VOLTAGE FLUID HEATER

CROSS-REFERENCE TO RELATED APPLICATIONS

The present application is a U.S. National Stage Application of, and claims priority to, PCT Application No. PCT/AU2010/000562 filed May 13, 2010, which claims priority to Australian Application No. 2009902161 filed May 14, 2009, U.S. Provisional Application No. 61/265,584 filed Dec. 1, 2009, and Australian Application No. 2010900772 filed Feb. 24, 2010, all of which are hereby incorporated by reference in their entirety.

BACKGROUND OF THE INVENTION

Consumers are becoming ever more aware of protecting our environment. Government and private industries are attempting to provide better products that meet consumer demands and concerns. Energy consumption is one of the prominent focal points in this environment debate and various projects and products have been proposed to reduce such consumption. One of the ways to reduce energy consumption is to provide more efficient methods for heating fluids, particularly for use in household, industrial, agricultural and commercial applications.

Heating methods for fluids traditionally comprise a heating element which is embedded within an insulated device and which then transfers heat by a range of methods including radiation, convection or conductance to an output surface. The heating element in such devices is typically fashioned as either a band or a wire made from an alloy containing nickel and/or chromium. However, such elements operating present a safety issue because of the risk of electrocution to the user. To overcome this risk, the element typically has an insulation layer around the element wire and a protective sheath around this insulation. These extra layers take some time to heat up which reduces efficiency.

Therefore it would be advantageous to provide safer and more efficient heating methods for fluids. One embodiment of the present invention provides an uninsulated yet safe heating element operable at low voltages. In order to avoid electric shock hazards, "low voltage" for purposes of this invention, ranges (depending on the application) between 1V and 42V, and ideally around about 24V.

FIELD OF THE INVENTION

The invention relates to improved methods of heating fluids, such as water or air.

SUMMARY OF THE INVENTION

The present invention provides a method of heating fluids comprising:

a. supplying a source of high voltage power of at least 100V;
b. transforming said high voltage to low voltage; and
c. heating an element with said low voltage thereby heating a fluid.

Preferably, the element is uninsulated.

Preferably, the element is insulated or partially insulated.

Preferably, the element is formed from nickel and chrome alloy or other alloys.

Preferably, the element comprises substantially 80% nickel and 20% chrome or other alloys.

Preferably, the fluid is a liquid or a gas.

Preferably, the liquid is water.

Preferably, the liquid is propylene glycol.

Preferably, the gas is air.

Preferably, the temperature of the element is raised to at least 400° C.

Preferably, the temperature of the element is raised to between 400° C. and 1700° C.

Preferably, the temperature of the element is raised to between 700° C. and 1700° C.

Preferably, the element is raised to between 1200° C. and 1700° C.

Preferably, the element is in the form of a wire.

Preferably, the diameter of the wire is between 0.2-4 mm.

In another aspect, the invention provides a heating assembly for heating hot water systems consisting of a non-insulated wired element operable at extra low voltage wherein the temperature of the element exceeds 800° C.

Preferably, the heating assembly or method according to the present invention is used in marine vessels.

Preferably, the heating assembly comprises a selection of switches for AC and DC usage.

In another aspect, the invention provides a method of heating water comprising:

a. supplying a source of high voltage power of at least 100V;
b. transforming said high voltage to low voltage; and
c. heating an uninsulated element with said low voltage thereby heating the water.

Preferably, low voltage ranges from about 22V to 28V.

The invention utilizes an uninsulated heating element operable at less than 42V and ideally around 24V for safe and efficient heating of fluids.

DEFINITIONS

For purposes of this application, the following definitions apply to various terms:

"low voltage" means between 1V and 42V, and ideally within a range of about 22V to 28V, with a preferred voltage of around 24V.

DETAILED DESCRIPTION OF THE INVENTION

Figure 1:
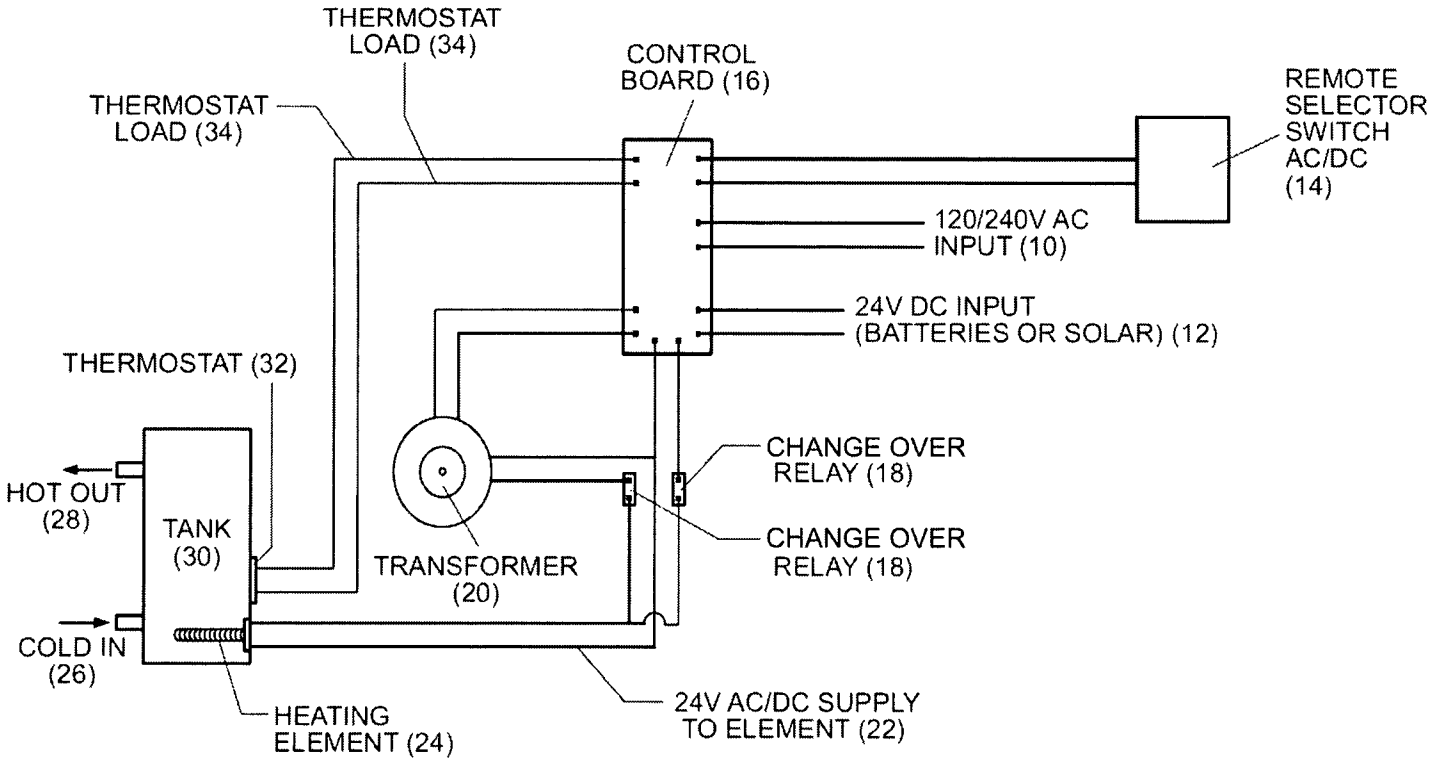
FIG. 1 shows a circuit diagram of a preferred embodiment of the invention.

As shown in FIG. 1, a preferred embodiment of the invention allows for either 120V or 240V AC input (10). These AC voltages are typical from the standard electrical outlet (depending on the country). Alternatively, a preferred embodiment of the invention accepts 24V DC input (12), for example, a solar panel or battery. In one preferred embodiment, multiple power sources may be used. If multiple power sources are available, a remote selector switch (14) can be used to toggle back and forth between power input sources using control board (16) and change over relays (18). Other input sources within the scope of the invention include DC/photovoltaic, alternators, wind generators, heat-exchange and other electrical power sources.

If AC voltage higher than 42V is used, transformer (20) is used to step down the voltage to less than 42V, and ideally within a range of about 22V to 28V, with a preferred embodiment at around 24V. The preferred embodiment uses a toriodal transformer, but alternatives would be apparent to one of skill in the art, such as step down transformers and switch mode power supplies. Regardless of the electrical input used, low voltage (in the preferred embodiment of FIG. 1, around 24V is supplied to uninsulated heating element (24).

Because the invention uses low voltage for heating element (24), the heating element is much safer than those run from convention higher voltage sources. Moreover, since the current entering into the heating element predominantly determines the amount of heat emitted/generated from uninsulated element (24), and not the voltage, using low voltage is more efficient. Since the Watts input into the system (which remain constant) divided by the voltage determines the current (in Amps), stepping down high voltage input sources using transformer (20) increases the electrical efficiency, such as from standard electrical outlets. This efficiency, plus the ability to use an uninsulated heating element (24) because of the safety of the low voltage power supply, means that use of the invention allows the user to heat fluids more safely while also decreasing power consumption.

In one preferred embodiment of FIG. 1, heating element (24) comprises a nickel and chrome alloy or other alloy. In one embodiment, the heating element comprises substantially 80% nickel and 20% chrome or other alloy. The heating element may comprise other metal compositions known in the art including alloy compositions comprising about 40% Nickel and 21% Chrome, commonly known as Incoloy®. Different compositions for heating element (24) would be apparent to one of skill in the art and are within the scope of invention.

In one preferred embodiment, heating element (24) is in the form of an uninsulated coil, wire or ribbon, although many other forms for heating element (24) are possible and within the scope of the invention, so long as the material is capable of withstanding high temperatures.

In one preferred embodiment of FIG. 1, the temperature of heating element (24) is raised to at least 400° C. Depending on the application (and the fluid heated) the temperature of the element may be between 700° and 1700° C.

As shown in the preferred embodiment of FIG. 1, fluid tank (30) can be any size, including the size of domestic tanks available in the market. The tanks include capacities ranging from 25 liters (l) to 2000 liters, typically 25 l, 50 l, 200 l, 250 l and 500 l. Typically, fluid tank (30) is made of mild steel with a porcelain enamel coating, plastic or stainless steel. However, other suitable materials such as chromium/titanium alloys may be used for construction of the tanks, including water tanks. Many alternatives in capacity and composition for fluid tank (30) would be apparent to one of skill in the art, and are within the scope of the invention.

The fluids heated by heating element (24) include water, but other fluids such as glycol and its derivatives (including propylene glycol) can be used. Moreover, it would be apparent to one of skill in the art that the invention could be used with fluids such as air and other gases as well.

As shown in one preferred embodiment of FIG. 1, the fluid in tank (30) is heated by the heating element (24). In one preferred embodiment of FIG. 1, thermostat (32), in conjunction with the thermostat leads (34) and control board (16) regulates the temperature of the fluid in tank (30). Thermostat (32) may use analog or digital controls, and may be programmable.

As shown in the preferred embodiment of FIG. 1, cold fluid comes into tank (30) by means of opening (26) while hot fluid is removed from tank (30) by means of opening (28). The fluid may be moved in and out of tank (30) by any conventional means, including convection. The invention would also cover closed heating methods.

Figure 2:
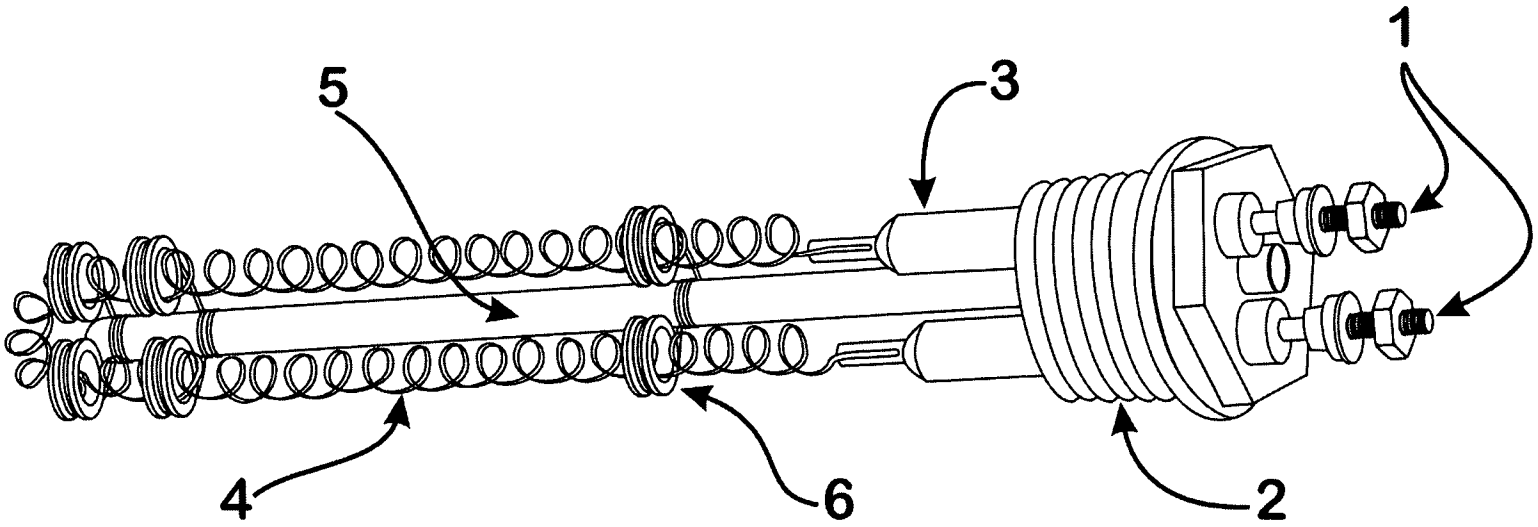
FIG. 2 shows an uninsulated heating element according to the invention designed for immersion in liquid.

In a preferred embodiment, the heating element is shown in FIG. 2. Terminals (1) are connected to an extra low voltage power supply, causing element (4) to heat. Cold pins (3) prevent heating of the terminals (1). Support arm (5) is either a rod or a tube and supports the ceramic bushes (6) which in turn support the element (4). The threaded boss (2) screws into the housing, or comprises other means of fixing available in the art such as a flange.

As an example, the power supply used for a Marine AC/DC 50 liter hot water system with provision for heat exchange connection to the engine cooling system is discussed.

The remote selector switch (1) for AC and (2) for DC, allows the user to select whether to use shore power/generator or alternator/battery systems depending on availability. The element previously described is installed at the base of the tank and is connected to both mains power and battery via the power pack. The selector automatically chooses main/shore power when available. Included in the power supply pack is a printed circuit board to protect the invention from transient voltages (brownouts, etc). In addition, the assembly comprises LED indicators and audible alarms for fault detection. This example is but one of the use of extra low voltage noninsulated elements. The power pack is mounted well clear of any bilge or water access and the tank can operate even if submerged with no safety issues. Submerging a mains powered hot water system would immediately render the water live and would short out, severely injuring or killing anyone standing in the water if not properly protected.

Thus, the present invention is suitable for heating a water system for domestic, public and commercial uses. Domestic use includes heating water in household water heating systems in private and public accommodations. Public accommodations include small to medium sized accommodations such as motels and camping sites. Commercial applications include use in the marine industry and in mining sites. In the mining sites, the heating system according to this invention reduces load on generators.

The present invention can also be suitable for use in existing heating systems. The existing systems may be easily and economically retro-fitted using the methods described herein. Furthermore, the power supply and heating element may be retro-fitted to existing utilities to heat air, hot water systems, spas, pools, toasters, hairdryers, household appliances including ovens, etc.

The present invention can also be used for heating air, for example, for heating air in clothes driers, ovens, grills and central heating. Normally these products use high voltages (either 240V/AC or 120V/AC, depending on the country) from the standard electrical outlet, including three phase power supply for industrial application.

In another embodiment the invention provides a method of heating a fluid comprising heating an element at low voltage.

In another embodiment, the invention provides a method of heating a fluid comprising heating an insulated or partially insulated element at low voltage.

In another embodiment, the invention provides a method of heating water comprising heating an element at low voltage. The water to be heated is stored in a common hot water system or tank, or is available instantaneously to the consumer.

The present invention allows for use of lower voltages for the power supply, thus increasing efficiency and providing greater electrical safety.

In another embodiment, the invention provides a method of heating fluids, such as water, comprising heating an insulated or partially insulated element at low voltage. Thus, insulated includes electrical insulation fully enclosing the element. Partially insulated includes only part e.g. one side of the element being insulated.

Another aspect of the invention relates to heating agricultural products including soil material or materials containing soil. The heating may be achieved by heating the moisture in the soil or by heating the soil material itself, according to the invention as described above.

Accordingly, it is to be understood that the embodiments of the invention herein described are merely illustrative of the application of the principles of the invention.

The claims defining the invention are as follows:

1. A method of heating water, comprising:

a. supplying a source of high voltage power of at least 100V;

b. transforming said high voltage to low voltage;

c. heating an electrically uninsulated immersion heating element with said low voltage thereby heating the water, wherein the electrically uninsulated heating element is formed from an about 80% nickel and 20% chrome alloy, wherein the low voltage ranges from about 22V to 28V; and d. selecting between shore power, a generator or an alternator, and a battery, via a remote selector switch to power the uninsulated immersion heating element, wherein the remote selector switch automatically selects shore power when shore power is available.

2. The method according to claim 1 wherein the element is a wire.

3. The method according to claim 2, wherein a diameter of the wire is between 0.2-4 mm.

4. The method according to claim 1, wherein low voltage is about 24V.

5. The method according to claim 1 for use in marine water heating systems.

6. The method according to claim 1, further comprising selecting switches for AC and DC usage.

7. The method according to claim 1, wherein the voltage is about 26V.

8. The method according to claim 1, wherein heating the electrically uninsulated immersion heating element comprises heating the electrically uninsulated immersion heating element for which a support arm coupled to ceramic bushes support the electrically uninsulated immersion heating element.

9. The method according to claim 8, wherein heating the electrically uninsulated immersion heating element comprises heating the uninsulated immersion heating element that is coupled to cold pins that prevent heating of terminals coupled to a power supply supplying an extra low voltage.

10. The method according to claim 1, wherein heating the electrically uninsulated immersion heating element comprises heating a coil, wire, or ribbon.

11. The method according to claim 1, wherein heating the electrically uninsulated immersion heating element comprises using a thermostat to heat the water to a desired temperature.

12. The method according to claim 1, wherein heating the electrically uninsulated immersion heating element comprises:

heating a single rod included in the electrically uninsulated immersion heating element.

13. The method of claim 1, wherein the electrically uninsulated immersion heating element is the only electrically uninsulated immersion heating element disposed within a tank holding water for heating by the electrically uninsulated immersion heating element.

14. The method of claim 13, wherein the tank includes only one element that is coupled to the low voltage.

* * * * *